US005887392A

United States Patent [19]

Martin

[11] Patent Number: 5,887,392

[45] Date of Patent: Mar. 30, 1999

[54] WINDOW JAMBLINER WITH REMOVABLY ATTACHED MEMBERS FOR BIASING AND SEALING

[75] Inventor: Jeffrey S. Martin, Cottage Grove, Minn.

[73] Assignee: Amesbury Group, Inc., Amesbury, Mass.

[21] Appl. No.: 797,177

[22] Filed: Feb. 10, 1997

[51] Int. Cl.[6] ..... E06B 3/00; E06B 7/22

[52] U.S. Cl. ..... 52/204.5; 52/716.2; 52/745.15; 49/484.1; 49/489.1; 49/495.1; 49/498.1

[58] Field of Search ..... 52/716.2, 717.05, 52/717.03, 204.5, 745.15; 49/419, 475.1, 480.1, 484.1, 489.1, 495.1, 498.1

[56] References Cited

U.S. PATENT DOCUMENTS 3,842,564 10/1974 Brown ..... 52/717.03
4,454,687 6/1984 Baker ..... 49/419
4,538,380 9/1985 Colliander ..... 49/489.1 X
4,712,330 12/1987 Beirnes ..... 49/489.1 X
5,245,788 9/1993 Riegelman ..... 49/489.1 X
5,581,951 12/1996 Ryan et al. ..... 49/498.1

*Primary Examiner*—Christopher Kent
*Attorney, Agent, or Firm*—Testa, Hurwitz & Thibeault, LLP

[57] ABSTRACT

A jambliner having a multi-part design includes a sash-engaging member defining a track and a pair of retaining arms extending from the sash-engaging member defining a channel. A resilient seal for biasing the jambliner against a window sash and sealing the jambliner against a jamb includes an elongated bulb having a spline of a shape corresponding to the shape of the channel. The resilient seal is removably attached to the sash-engaging portion through the mating of the spline and the retaining arms to form a dove-tail joint. The jambliner of the present invention facilitates replacement of the resilient seal after jambliner installation, as well as customization of the compression characteristics of the resilient seal to achieve specific biasing and sealing needs.

22 Claims, 6 Drawing Sheets

WINDOW JAMBLINER WITH REMOVABLY ATTACHED MEMBERS FOR BIASING AND SEALING

FIELD OF THE INVENTION

This invention relates to a jambliner for a window assembly, more particularly to a jambliner having removably attached members for enhanced biasing and sealing.

BACKGROUND OF THE INVENTION

Double hung window assemblies generally include a frame, an upper window sash, a lower window sash, a pair of balances, and a pair of jambliners. The jambliners are each attached to a window jamb to guide the movement of the window sashes. A seal is typically disposed between the jambliner and the window jamb to block the infiltration of air into the space between the jamb and the jambliner, and to provide a biasing force that causes the jambliners to frictionally engage the sides of the sashes to maintain the sashes at desired positions.

In conventional window assemblies, the seal typically comprises a foam backing member or a jamb-engaging flap co-extruded with the jambliner. The foam backing member typically comprises a block of polyurethane foam affixed to the jambliner by a hot-melt adhesive. Although foam backings generally provide a sufficient biasing force after installation, it has been found that the foam has a limited useful life and degrades after repeated exposure to environmental elements such as wind and rain. As a result, the foam becomes brittle and hard, losing elasticity and the ability to prevent the leakage of air and moisture. Although in such instances replacement of foam backings is necessary, replacement can be quite messy and tedious, as the hot-melt adhesive must be reapplied for attachment of a new foam backing member.

The use of co-extruded flaps has eliminated the difficulty associated with the removal and replacement of foam backings, as the jambliner and the flap are integrally formed. However, such an integral construction has led to the need for replacement of the entire jambliner when the flap is inoperative due to defective design, breakage, or wear and tear. Furthermore, the process of co-extruding such flaps is often of increased complexity due to the differential cooling rates associated with the material used to form the flap and the material used to form the remainder of the jambliner. Moreover, the compression characteristics of co-extruded members cannot be altered after fabrication.

SUMMARY OF THE INVENTION

The present invention relates to a jambliner for use in a window assembly having removably attached sealing members that afford increased resistance to air infiltration, adjustment of compressive forces against a window sash, and ease of installation and repair. In one embodiment, the jambliner has a sash-engaging member defining a track having opposed wall sections and a bottom wall. Extending from one surface of the bottom wall are a pair of retaining arms that define a channel. An elongated resilient seal having a hollow interior and a spline of a shape corresponding to the shape of the channel, mates with the sash-engaging member. In this embodiment, the spline is slidably received in the channel defined by the retaining arms.

In another embodiment, the resilient seal is a tubular or bulb-shaped elongated member for sealing the jambliner along the length of the jamb, and the spline defines a T-shaped member slidably received in a T-shaped channel defined by the retaining arms. In still another embodiment, the spline defines a C-shaped member forming a snap-fit connection with a C-shaped channel defined by the retaining arms.

In still another embodiment of the present invention, the jambliner comprises a pair of resilient seals, each of which comprises a semi-circular bulb.

In another embodiment of the present invention, the resilient seals can have a compression rating within the range of 0.75 lb/inch to 1.5 lb/inch, thereby enhancing the jambliner's resistance to air infiltration. Additionally, each resilient seal can further comprise a tubular member of differing thickness, thereby providing differing biasing forces to the top and bottom window sashes.

In yet another embodiment of the present invention, the jambliner includes an additional seal disposed between the pair of resilient seals, to provide enhanced sealing and biasing characteristics. The additional seal comprises a reinforced bulb and spline that is slidably disposed within a channel formed by an additional pair of retaining arms.

In yet another embodiment of the present invention, the jambliner comprises an additional pair of resilient seals disposed between the pair of resilient seals. Each of the additional resilient seals comprises a bulb having a foam-filled inner core and a spline that is slidably disposed within a channel formed by an additional pair of retaining arms. The foam-filled inner core enhances the sealing capabilities of the bulb, and can provide an increased biasing force against a window sash.

In still another embodiment of the present invention, the jambliner comprises a pair of wall extensions emanating from a sash-engaging member. The wall extensions have a pair of retaining arms that form a snap-fit coupling with a resilient seal of reduced size.

In still another embodiment of the invention, a method of installing a jambliner in a window assembly comprises providing a sash-engaging member having retaining arms that define a channel, providing a resilient seal having a spline of a shape corresponding to the shape of the channel, inserting the spline into the channel defined by the pair of retaining arms, and attaching the resilient seal to a window jamb. The present invention further provides removing the resilient seal and attaching a new resilient seal by slidably removing the spline from contact with the retaining arms, and slidably inserting the spline of a new resilient seal into the channel.

As will be further described, the multi-component design of the jambliner of the present invention overcomes the disadvantages associated with conventional foam backings and co-extruded members. By using a resilient seal removable by sliding or pulling the resilient seal from the sash-engaging member, the entire jambliner need not be replaced in the event of malfunction of the seals due to wear, defective design, faulty manufacturing, or breakage. Moreover, the ease of replacement provided by the jambliner of the present invention facilitates upgrading and customization of the resilient seals.

These and other features of the invention will be made apparent from the description below and the claims.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF THE INVENTION

Figure 1:
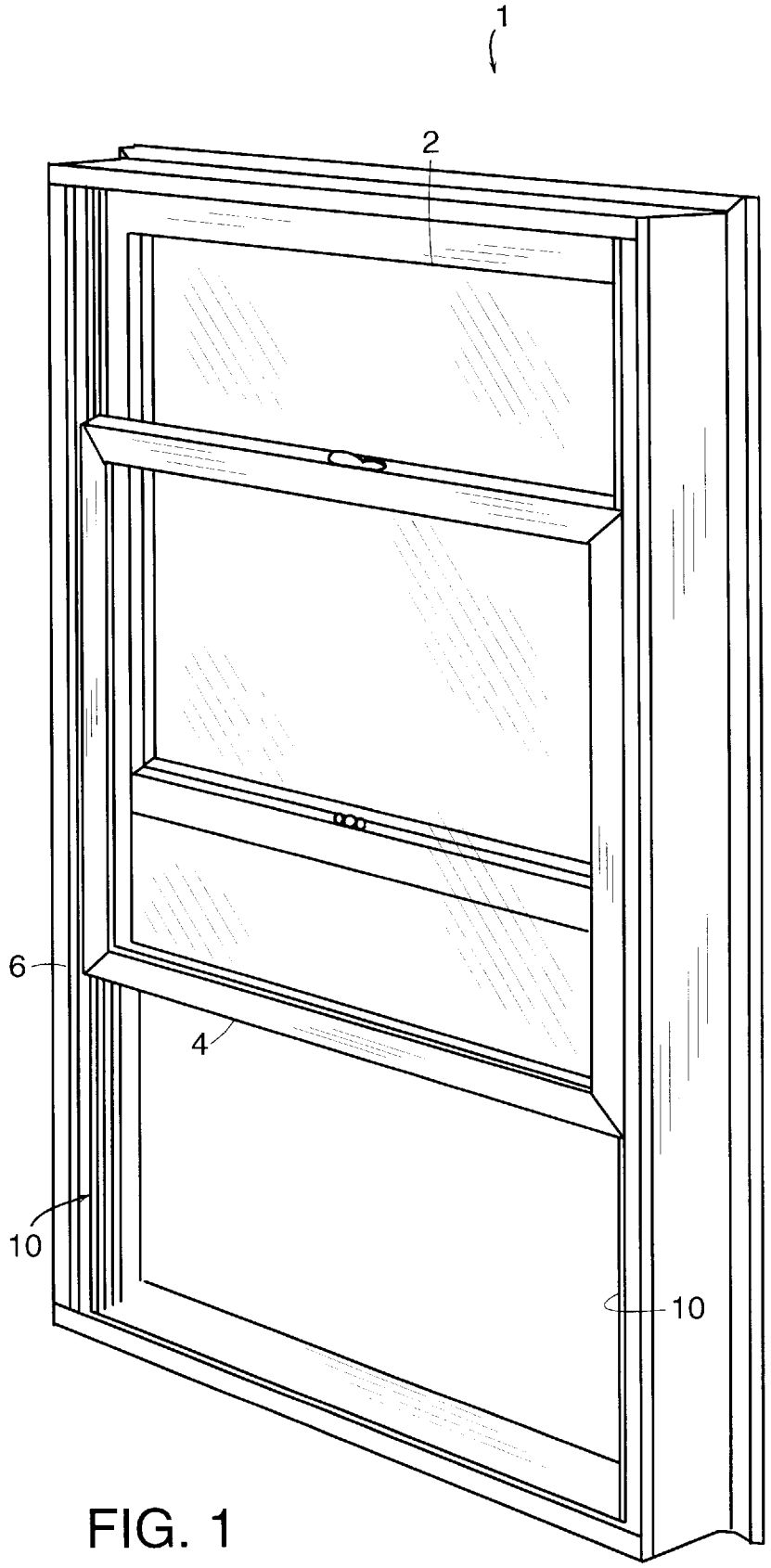
FIG. 1 is a perspective view of a double hung window assembly in which the jambliner of the present invention can be used.

Referring to FIG. 1, shown is a double-hung window assembly 1 having a jambliner 10 constructed in accordance with the teachings of the present invention. As shown, the window assembly 1 has an upper sash 2 and a lower sash 4. The upper and lower sashes 2, 4 are supported by a pair of jambliners 10, one on each side of the window jamb 6. As will be further shown, each jambliner 10 defines a track for guiding each sash 2, 4 while permitting the sashes 2, 4 to slide vertically in response to forces exerted thereon. The jambliners 10 mounted on either side of the frame 6 are substantially identical.

Figure 2:
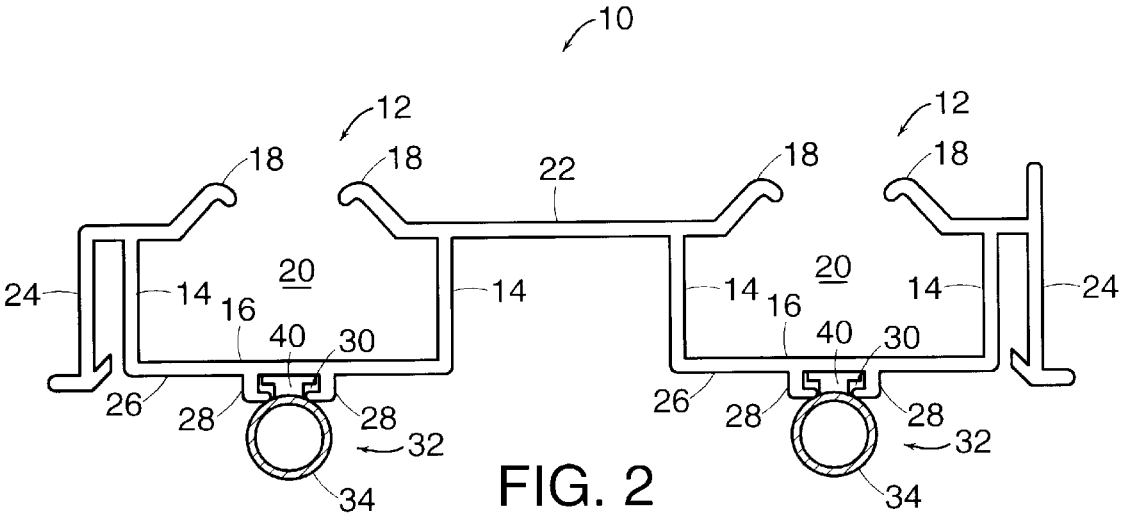
FIG. 2 is a cross-sectional view of one embodiment of the jambliner of the present invention, having a T-shaped channel attaching a resilient seal.

Referring to FIG. 2, shown is a cross-sectional view of one embodiment of the jambliner 10 of the present invention. The jambliner 10 is preferably comprised of a polymeric material such a polyvinylchloride (PVC) having varying hardness and compression characteristics, as will be further described. The jambliner 10 includes a pair of sash-engaging members 12 each comprising a pair of side walls 14, a bottom wall 16, and a pair of shortened walls 18, all of which cooperate to form a pair of elongated tracks 20. The tracks 20 are substantially identical, one configured to guide a lower sash (not shown), and the other configured to guide an upper sash (not shown). The tracks are connected by a mullion 22. Disposed on either side of the tracks 20 is an edge member 24 that can be used to mount the jambliner 10 to the window jamb (not shown).

Projecting from the bottom surface 26 of the bottom wall 16 are a pair of retaining arms 28 that cooperate with the wall 16 to define a channel 30. In another embodiment, the retaining arms 28 may not be needed to defined the channel 30, particularly where the bottom wall 16 is of sufficient thickness to have a groove defined therein. Disposed within the channel 30 defined by the retaining arms 28 is a resilient seal 32 for biasing the jambliner 10 against a window sash (not shown) and for sealing the jambliner 10 against a window jamb (not shown). The resilient seals 32 are preferably sized to be about equivalent or greater than offset space (not shown) defined between the jambliner 10 and the window jamb (not show).

Figure 3A:
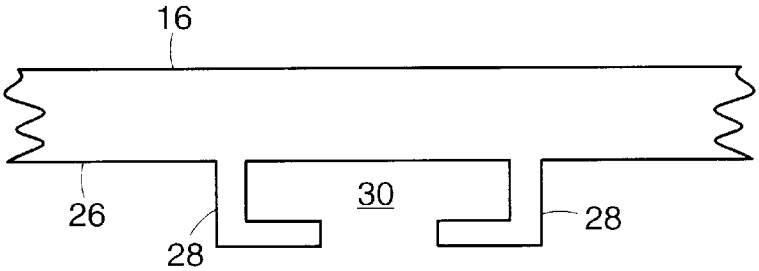
FIG. 3A is a cross-sectional view of the T-shaped channel defined by a pair of retaining arms extending from the sash-engaging member of an embodiment of the present invention shown in FIG. 2.

Referring to FIG. 3A, shown in further detail are the retaining arms 28 defining the channel 30. It is to be appreciated that the retaining arms 28 can assume any shape provided that the resilient seal 32 can form a friction fit therewith, as will be further described.

Figure 3B:
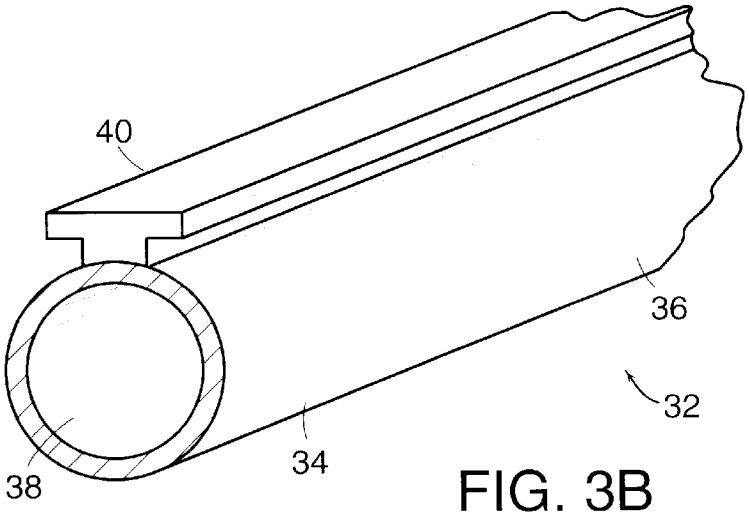
FIG. 3B is a perspective view of the resilient seal of the embodiment of the present invention shown in FIG. 2.

Referring to FIG. 3B, shown in further detail is one embodiment of the resilient seal 32 of the present invention. As shown, the resilient seal 32 comprises an elongated tubular member, hereinafter referred to as a bulb 34. The bulb 34 has an outer surface 36 and an inner surface 38. Disposed on the outer surface 36 is an elongated spline 40. In this embodiment, the spline 40 assumes a T-shape that cooperates with the channel 30 defined by the retaining arms 28. It is to be appreciated that the spline 40 can form a rounded member or a pointed member, provided that the shape of the spline 40 cooperates with the above-described shape of the channel 30 defined by the retaining arms 28 to form a dove-tail joint. It is to be understood that a dove-tail joint shall refer to any cooperating multi-part construction that enables the spline 40 to be slidably or frictionally retained within a channel defined by the retaining arms 28 or a groove (not shown) in the wall 16. The spline 40 preferably comprises PVC or other polymeric material similar to that of the retaining arms 28.

The bulb 34 is preferably a flexible material suitable for biasing the jambliner 10 against a window sash (not shown) and sealing the jambliner 10 against the jamb (not shown). To perform such functions, the bulb 34 is preferably of greater flexibility than the spline 40 and the sash-engaging members 12. The bulb 34 of the present embodiment can further have a compression rating within the range of 0.75 lb/inch to 1.5 lb/inch. It has been discovered that such a compression rating significantly improves the resistance of the jambliner 10 to air infiltration in the space between the jambliner 10 and the window jamb (not shown). It is important to note however, that the present invention should not be limited to such a range of compression ratings and that other compression ratings outside of the above range can be desirable. In another embodiment, the bulb 34 can have a compression rating of about 1.4 lb/inch.

Referring again to FIG. 2, the spline 40 is slidably retained in the channel 30 defined by the retaining arms 28. The T-shaped spline 40 forms a friction fit with the retaining arms 28, and is thus retained in place after insertion into the channel 30. In the absence of a direct pulling or pushing force exerted thereon, the spline 40 is prevented from sliding out of channel 30. As the bulb 34 is integrally connected with the spline 40, it too is retained in place. A jambliner 10 of unitary construction is created by the interfitting connection of the retaining arms 28 of each sash-engaging member 12 with the spline 40 of each resilient seal 32. Once the jambliner 10 is formed as a single unit, it can be affixed to the window jamb (not shown).

In operation, the bulb 34 provides an effective biasing force that biases the jambliner 10 against the window (not shown). Additionally, the bulb 34 further prevents infiltration of air though the space defined between the jambliner 10 and the jamb (not shown). In the event however, that the bulb 34 or the spline 40 forming the resilient seal 32 become inoperative due to wear, defective design or breakage, the jambliner 10 does not have to be completely replaced. With the construction of the present invention, only the resilient seal 32 need be replaced. This task is easily accomplished by sliding the spline 40 along the length of the channel 30 until the spline 40 disengages from contact with the retaining arms 28. Upon disengagement of the spline 40 from the retaining arms 28, a new resilient seal 32 can be inserted. Thus, the upper portion of the jambliner 10, such as, for example, the sash engaging member 12 with retaining arms 28, mullion 22, and edge members 24, can be re-used.

It is important to note that removal of the resilient seal 32 need not occur only in response to an inoperative resilient seal 32. Rather, the resilient seals 32 can be upgraded after installation due to changed requirements for biasing forces and resistance to air infiltration. Changed requirements may necessitate the use of a resilient seal 32 having a bulb 34 of a specific material, thickness, and/or compression rating. In such an instance, the resilient seals 32 can be easily replaced by removing the resilient seals 32 and inserting a new seal capable of satisfying such requirements.

Figure 4:
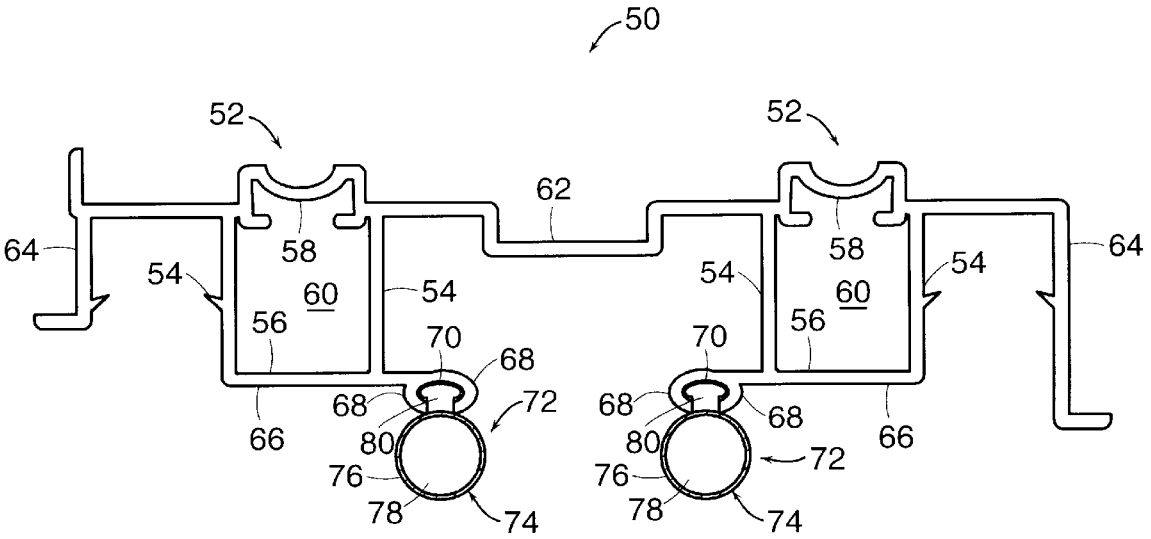
FIG. 4 is a cross-sectional view of another embodiment of the jambliner of the present invention, having a C-shaped channel forming a snap-fit attachment with a resilient seal.

Referring to FIG. 4, shown is another embodiment of the jambliner 50 of the present invention. As similarly described above, the jambliner 50 includes a pair of sash-engaging members 52 each comprising a pair of side walls 54, a bottom wall 56, and a top wall 58, all of which combine to form a pair of closed elongated tracks 60. The tracks 60 are substantially identical, one configured to guide a lower sash (not shown), and the other configured to guide an upper sash (not shown). The tracks are connected by a mullion 62. Disposed on either side of the tracks 60 is an edge member 64 that can be used to mount the jambliner 50 to the window jamb (not shown).

Disposed on the bottom surface 66 of the bottom wall 56 are a pair of retaining arms 68 that define a C-shaped channel 70. Disposed in the channel 70 defined by the retaining arms 68 is a resilient seal 72 for biasing the jambliner 50 against a window sash (not shown) and for sealing the jambliner 50 against a window jamb (not shown). The resilient seal 72 comprises an elongated bulb 74 having an outer surface 76 and an inner surface 78. Disposed on the outer surface 76 is an elongated spline 80. In this embodiment, the spline 80 assumes a rounded C-shape.

To attach the sash-engaging member 52 to the resilient seal 72, the spline 80 is forced into contact with the retaining arms 68, which move slightly apart in response to the force exerted thereon by the spline 80. As the retaining arms 68 move, the spline 80 is inserted into the channel 70 defined by the retaining arms 68 to form a snap-fit coupling with the retaining arms 68. When it is desired to remove the resilient seal 72, the resilient seal 72 is simply pulled in a direction away from the retaining arms 68. The frictional force maintaining the spline 80 within the channel 70 is thus overcome, as the retaining arms 68 again move slightly apart as the spline 80 is pulled away from the retaining arms 68. After removal, a new resilient seal 72 can be inserted, as similarly described above.

Figure 5:
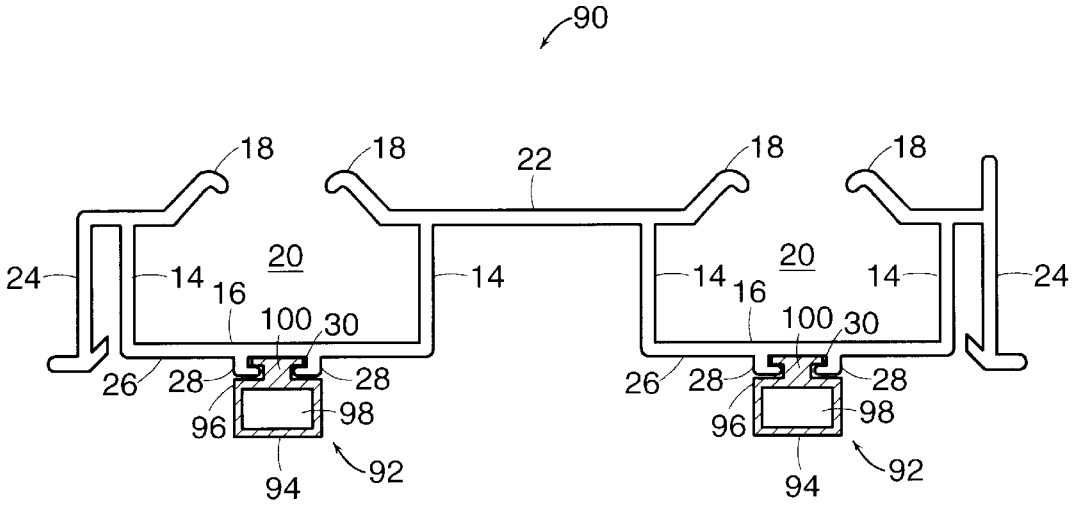
FIG. 5 is a cross-sectional view of yet another embodiment of the jambliner of the present invention, having resilient seals comprising square bulbs.

Referring to FIG. 5, shown is yet another embodiment of the jambliner 90 of the present invention. In this embodiment, some of the features of the jambliner 90 are essentially the same as those described in FIG. 2, and to eliminate redundancy, like reference numerals are shown but are not described. As shown in this embodiment, a pair of resilient seals 92 can comprise a bulb 94 having a square or rectangular shape. As similarly described above, the bulb 94 preferably includes an outer surface 96 and an inner surface 98. Disposed on the outer surface 96 of the bulb 94 is an elongated T-shaped spline 100. In this embodiment, the resilient seal 92 can further have a compression rating that falls within the range of about 0.75 lb/inch to about 1.5 lb/inch, as similarly described above, to increase the resistance of the jambliner 90 to air infiltration. It is important to note that the resilient seal 92 can have a compression rating outside of this range, depending upon the needs and/or requirements of the user. The jambliner 90 of the present embodiment can be particularly useful where a specific biasing force on a window sash (not shown) is more easily achieved with a bulb 94 of a square shape, or where enhanced sealing is afforded by a square shape given the size and/or shape of the space (not shown) defined between the jambliner 90 and the window jamb (not shown).

Figure 6:
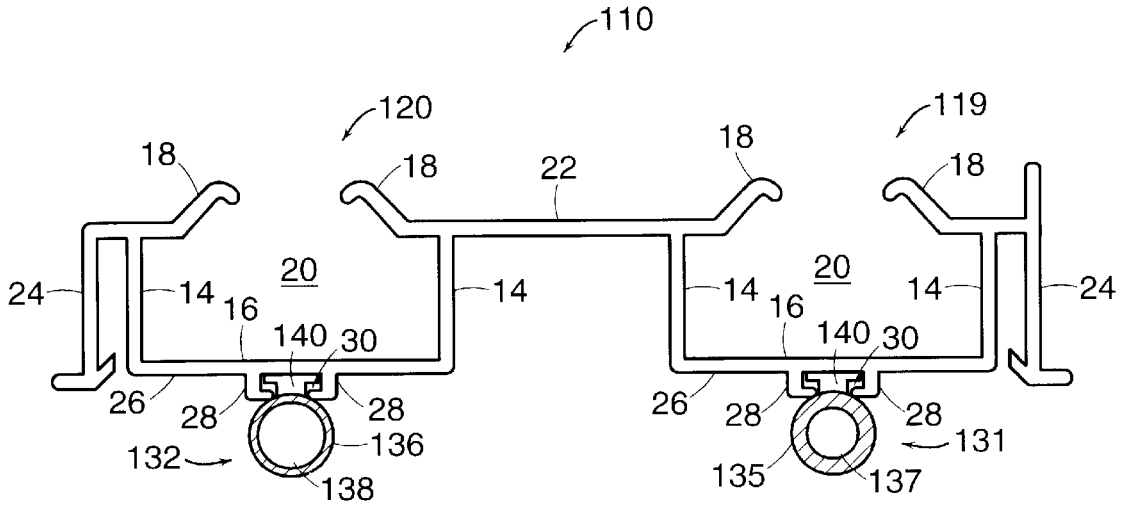
FIG. 6 is a cross-sectional view of another embodiment of the jambliner of the present invention, having resilient seals of differing compression characteristics.

Referring to FIG. 6, shown is still another embodiment of the jambliner 110 of the present invention. In this embodiment, some of the features of the jambliner 110 are essentially the same as those described in FIG. 2, and again, to eliminate redundancy, like reference numerals are shown but not described. As shown in this embodiment, the jambliner 110 includes a pair of resilient seals 131, 132, each having an outer surface 135, 136 and an inner surface 137, 138. Disposed on the outer surface 135, 136 is an elongated spline 140. In the present embodiment, the thickness of each of the resilient seals 131, 132 differs, thus providing differing compression forces to the window sashes (not shown).

The embodiment of FIG. 6 can be used for example, when it is desired that a top sash of a double hung window remain in place without sagging, while a lower sash is operated with a minimal amount of force. In such an example, the sash-engaging member 119 associated with the resilient seal 131 having an increased thickness would thus be placed in a jamb track (not shown) associated with a top sash (not shown). The top sash (not shown) would therefore refrain from sagging, as the jambliner 110 would exert a strong biasing force thereon. Similarly, the sash-engaging member 120 associated with the resilient seal 132 having a decreased thickness would be placed in the jamb track (not shown) associated with the lower sash (not shown). The lower sash (not shown) would thus be easily operated as the biasing force on the sash (not shown) would be reduced.

Figure 7:
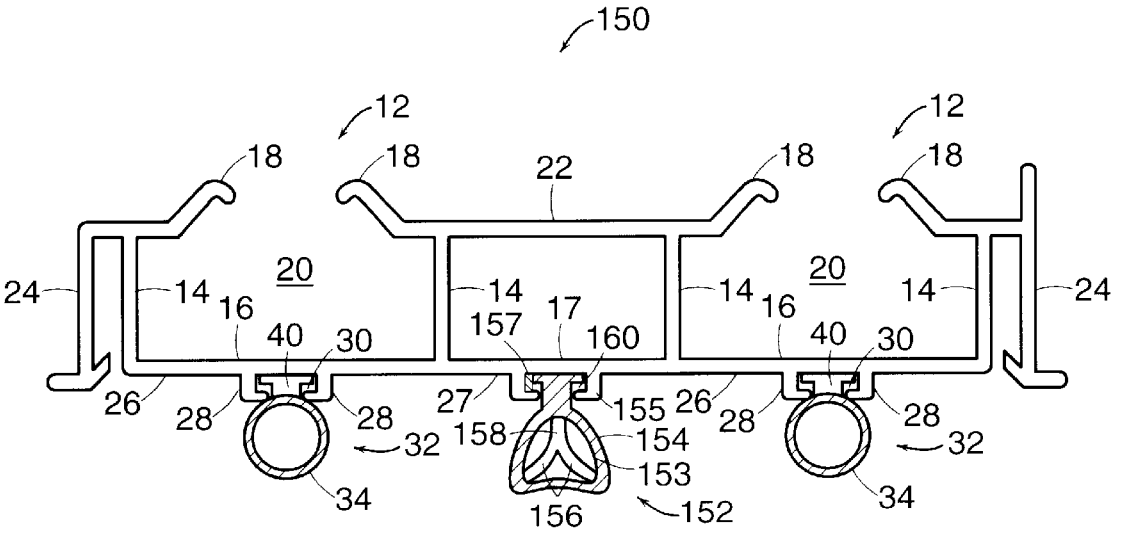
FIG. 7 is a cross-sectional view of another embodiment of the jambliner of the present invention, having an additional channel disposed at about the midpoint of the sash-engaging member attaching a reinforced seal.

Referring to FIG. 7, shown is yet another embodiment of the jambliner 150 of the present invention, having an additional seal 152 that provides enhanced sealing and biasing characteristics. In this embodiment, some of the features of the jambliner 150 are essentially the same as those described in FIG. 2, and to eliminate redundancy, like reference numerals are shown but are not described. As shown in this embodiment, the bottom walls 16 of the tracks 20 are joined together by a middle wall 17. Projecting from the bottom surface 27 of the middle wall 17 are a pair of retaining arms 155 that cooperate with the bottom surface 27 to define a channel 157. As similarly stated above, although the channel is shown as being T-shaped, it is to be appreciated that the channel may assume other shapes.

Disposed within the channel 157 is a reinforced seal 152. The seal 152 comprises a bulb 154 which, although shown in the present embodiment as being triangular in shape, can assume other shapes or configurations. The bulb 154 is preferably hollow and has a pair of interior support walls 156 emanating from the inner surface 153 of the bulb 154, that join to form a middle wall 158. The walls 156, 158 strengthen the bulb 154 and control the biasing force exerted thereby. The compression rating of the bulb 154 can be greater or less than the compression rating of the resilient seals 32, depending upon the needs of the user. As similarly described above with respect to the resilient seals 32, the additional seal 152 includes an elongated spline 160 emanating from the bulb 154 that can assume a T-shape or other shape, to cooperate with the channel 157 formed by the pair of retaining arms 155. The seal 152 can be inserted into and removed from the channel 157 by sliding, thereby providing ease of removal and replacement in the event of breakage or malfunction. The jambliner 150 according to the present embodiment is typically desirable in applications where the need to prevent air infiltration through the spaces between the jambliner 150 and the window jamb (not shown) is great. In such instances, the additional seal 152 provides an added barrier to air and/or moisture.

Figure 8A:
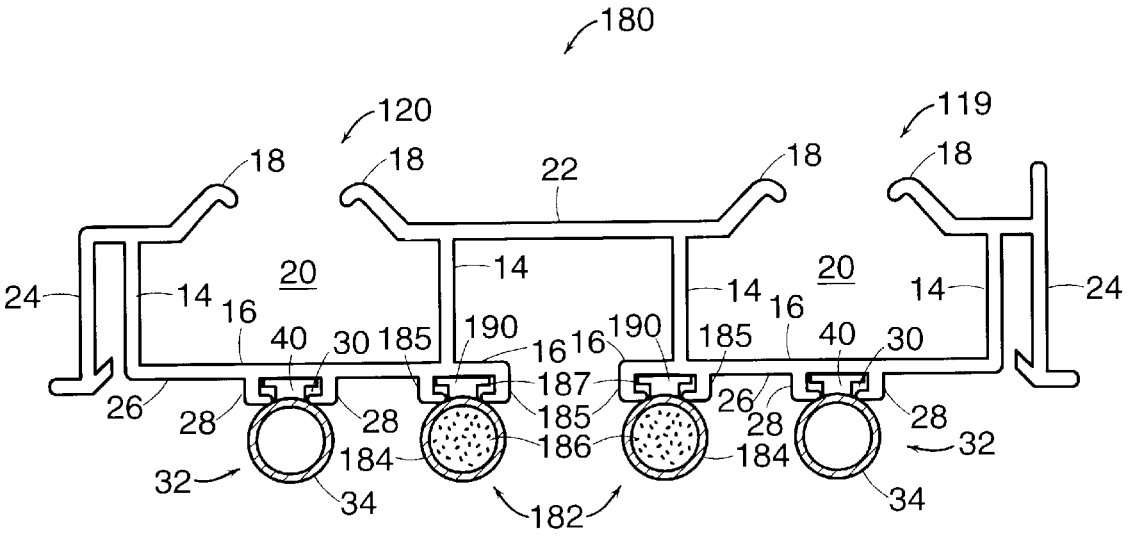
FIG. 8A is a cross-sectional view of another embodiment of the jambliner of the present invention, having an additional pair of resilient seals comprising foam-filled bulbs.

Referring to FIG. 8A, shown is yet another embodiment of the jambliner 180 of the present invention, having a pair of foam-filled resilient seals 182. In this embodiment, some of the features of the jambliner 180 are essentially the same as those described in FIG. 2, and to eliminate redundancy, like reference numerals are shown but are not described. As shown, the bottom walls 16 of the tracks 20 are extended slightly beyond the side walls 14 toward the mullion 22. Projecting from the bottom surface 26 of the bottom walls 16 on either side of the mullion 22 are an additional pair of retaining arms 185 that cooperate with the bottom surface 26 to define a T-shaped channel 187. As similarly stated above, although the channel is shown as being T-shaped, it is to be appreciated that the channel may assume other shapes.

Disposed within each channel 187 is a resilient seal 182. The seal 182 is formed of a bulb 184, preferably a tube having a foam-filled inner core 186. The foam-filled inner core 186 enhances the sealing capabilities of the bulb 184, and can provide an increased biasing force on a window sash (not shown). As similarly described above with respect to the resilient seals 32, the foam-filled resilient seal 182 includes an elongated spline 190 emanating from the bulb 184 and assuming a T-shape to cooperate with the channel 187. The foam-filled resilient seal 182 can therefore be inserted into and removed from the channel 187 by sliding, thus providing ease of removal and replacement in the event of breakage, malfunction, or loss of elasticity of the foam core 186.

Figure 8B:
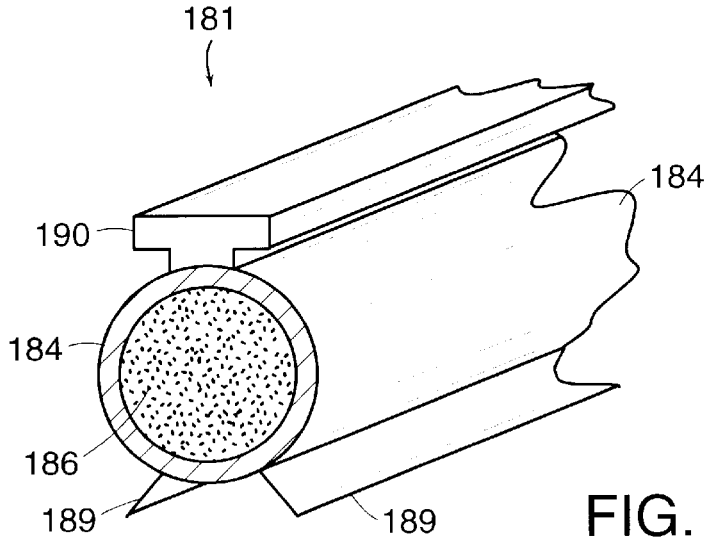
FIG. 8B is a cross-sectional view of another embodiment of the resilient seals of FIG. 8A.

Referring to FIG. 8B, in another embodiment, the bulb 184 and foam core 186 can further include flaps 189. The flaps 189 are preferably formed of PVC or TPE and are co-extruded with the bulb 184. The flaps 189 can provide enhanced sealing and compression characteristics to the seal 181.

Figure 9:
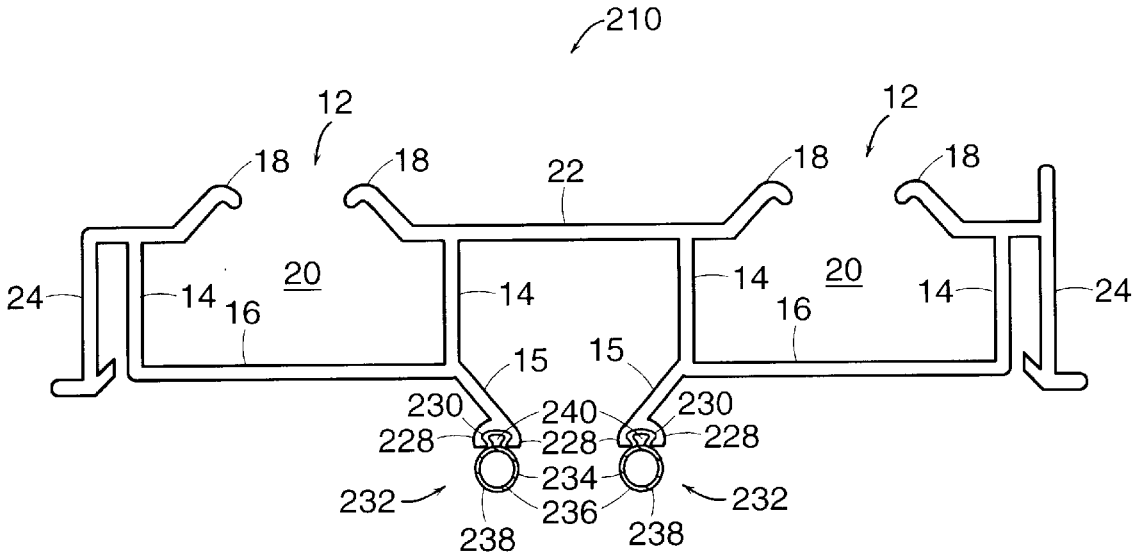
FIG. 9 is a cross-sectional view of another embodiment of the jambliner of the present invention, having a pair of resilient seals comprising bulbs of reduced diameter.

Referring to FIG. 9, shown is still another embodiment of the jambliner 210 of the present invention having resilient seals 232 of reduced size. In this embodiment, some of the features of the jambliner 210 are essentially the same as those described in FIG. 2, and to eliminate redundancy, like reference numerals are shown but are not described. In the present embodiment, the side walls 14 have lower wall extensions 15 that terminate in a pair of retaining arms 228 defining a C-shaped channel 230. The lower wall extensions 15 are typically of a length that is slightly less than an offset space (not shown) between the jamb (not shown) and the jambliner 210. In the present embodiment, the lower wall extensions 15 can be formed of relatively rigid PVC.

Disposed within the channel 230 defined by the retaining arms 228, and forming a snap-fit therewith, is a resilient seal 232 for biasing the jambliner 210 against a window sash (not shown) and for sealing the jambliner 210 against a window jamb (not shown). The resilient seal 232 comprises a bulb 234 of reduced size having an outer surface 236 and an inner surface 238. The bulb 234 can be formed of TPE as described above. Disposed on the outer surface 236 is an elongated spline 240. In this embodiment, the spline 240 assumes a rounded C-shape, as similarly described in FIG. 4.

To attach the resilient seal 232 to the remainder of the jambliner 210, the spline 240 is forced into contact with the retaining arms 228, which move slightly apart in response to the force exerted thereupon by the spline 240. As the retaining arms 228 move, the spline 240 is inserted into the channel 230 defined by the retaining arms 228, to form a snap-fit coupling with the retaining arms 228. When it is desired to remove the resilient seal 232, the resilient seal 232 is simply pulled in a direction away form the retaining arms 228. The frictional force maintaining the spline 240 within the channel 230 is thus overcome, as the retaining arms 228 again move slightly apart as the spline 240 is removed. After removal, a new resilient seal 232 can be inserted.

The fabrication costs associated with the jambliner of FIG. 9 are quite economical. As the lower wall extensions 15 afford a reduction in the size of the bulb 234, the amount of costly TPE needed to fabricate the jambliner 210 is therefore reduced.

Figure 10:
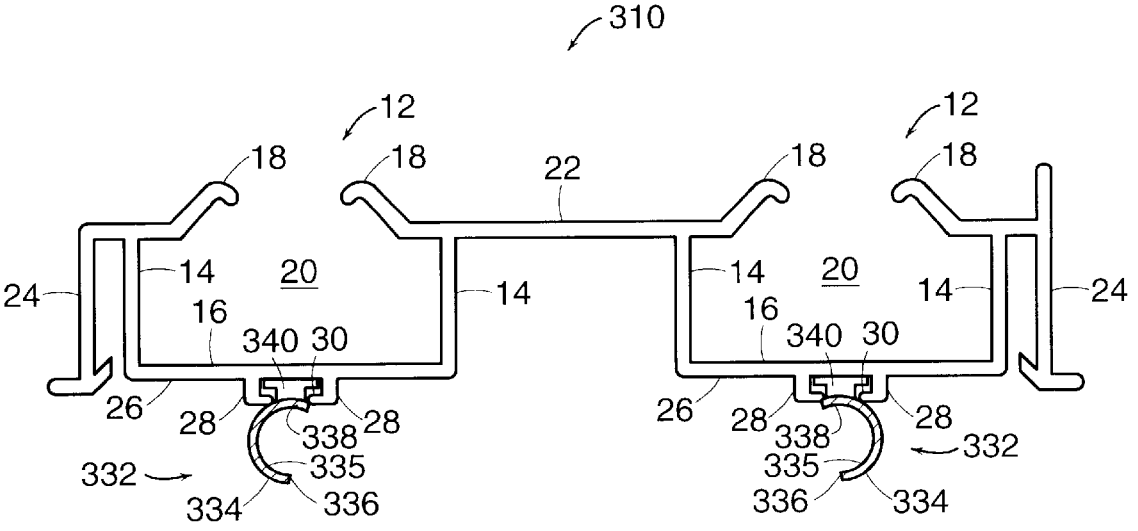
FIG. 10 is a cross-sectional view of another embodiment of the jambliner of the present invention, having a pair of resilient seals comprising semi-circular bulbs

Referring to Figure 10, shown is still another embodiment of the jambliner 310 of the present invention. In this embodiment, some of the features of the jambliner 310 are essentially the same as those described in FIG. 2, and to eliminate redundancy, like reference numerals are shown but are not described. As shown in this embodiment, each of the resilient seals 332 comprises a semi-circular bulb 334. Each of the semi-circular bulbs 334 has a distal end 336 and a proximal end 338. A spline 340 is attached to each bulb 334 at the proximal end 338. As shown, the spline 340 can be T-shaped for receipt within the channel 30. In alternative embodiments, the spline 340 can assume other shapes as described above.

The semi-circular bulbs 334 are preferably formed of TPE. In other embodiments the semicircular bulbs 334 can include layers of foam disposed on the concave surface 335 of the bulb 334 to further enhance the overall compression characteristics of the resilient seals 332. An advantage to the jambliner 310 shown in FIG. 10 is the reduced amount of TPE needed to fabricate the bulbs 334. As indicated above, a reduction in the amount of TPE required for the bulbs 334 can reduce the fabrication cost of the jambliner 310.

The multi-part jambliner construction of the present invention increases the flexibility that the user has in repairing a worn jambliner, as well as in customizing a jambliner to meet desired biasing and sealing needs. It is to be appreciated that the splines as well as the retaining arms described herein can assume a variety of shapes and sizes. It is important to note however, that such shapes and sizes must enable a spline and cooperating retaining arms to form an interfitting connection sufficient to retain the spline and ultimately, the resilient seal, in secure engagement with the retaining arms. Notwithstanding such engagement, it is to be appreciated that a spline can be further secured within the channel defined by the retaining arms with adhesives or other securing services.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A window jambliner comprising:

a sash-engaging member defining a track having opposed wall sections and a bottom wall, the bottom wall including a pair of retaining arms extending therefrom and defining a channel; and a resilient seal including a spline, the spline having a shape corresponding to a shape of the channel, the spline removably received within the channel defined by the retaining arms for coupling the resilient seal with the bottom wall.

2. The window jambliner according to claim 1, the resilient seal comprising an elongated bulb.

3. The window jambliner according to claim 2, the elongated bulb having a foam-filled core.

4. The window jambliner according to claim 1, the resilient seal comprising a semi-circular elongated bulb.

5. The window jambliner according to claim 1, the retaining arms defining a T-shaped channel.

6. The window jambliner according to claim 5, the spline defining a T-shaped member forming a joint with the T-shaped channel.

7. The window jambliner according to claim 1, the spline being slidably received by the retaining arms.

8. The window jambliner according to claim 1, the spline forming a snap-fit connection with the retaining arms.

9. The window jambliner according to claim 1, the resilient seal having a compression rating within the range of 0.75 lb/inch to 1.5 lb/inch.

10. The window jambliner according to claim 9, the resilient seal having a compression rating of approximately 1.4 lb/inch.

11. The window jambliner according to claim 1, further comprising a wall extension disposed between the bottom wall and the retaining arms.

12. A jambliner for use in a window assembly having a jamb, a lower sash, and an upper sash, comprising:

a pair of sash-engaging members, each sash-engaging member comprising opposed wall sections and a bottom wall, the bottom wall including a plurality of retaining arms extending therefrom and defining a first channel and a second channel; and a first resilient seal comprising a first spline frictionally retained by the retaining arms of the first channel, and a first bulb having a first thickness; and a second resilient seal comprising a second spline frictionally retained by the retaining arms of the second channel, and a second bulb having a second thickness that differs from the first thickness;

wherein the first and second resilient seals provide differing compressive forces to the sash-engaging members.

13. The window assembly according to claim 12, wherein the first and second bulbs each have a compression rating of at least 0.75 lb/inch.

14. The window assembly according to claim 12, further comprising a reinforced seal disposed between the first and second resilient seals.

15. The window assembly according to claim 14, wherein the reinforced seal has a compression rating that differs from the compression ratings of the first and second resilient seals.

16. The window assembly according to claim 14, wherein the reinforced seal comprises internal support walls.

17. The window assembly according to claim 12, wherein each of the first and second splines forms a snap-fit connection with the retaining arms of the first and second channels, respectively.

18. The window assembly according to claim 12, where the first and second splines are slidably disposed in the first and second channels.

19. A method for installing a jambliner in a window assembly comprising:

providing a sash-engaging member defining a track having opposed wall sections and a bottom wall, the bottom wall including a pair of retaining arms extending therefrom and defining a channel;

providing a resilient seal having a spline of a shape corresponding to a shape of the channel;

inserting the spline into the channel defined by the pair of retaining arms; and attaching the jambliner to a window jamb.

20. The method according to claim 19, the inserting step further comprising sliding the spline into the channel.

21. The method according to claim 20, further comprising sliding the spline out of the channel and sliding a spline of another resilient seal into the channel.

22. The method according to claim 19, the inserting step further comprising snap-fitting the spline into the channel.

* * * * *

UNITED STATES PATENT AND TRADEMARK OFFICE

CERTIFICATE OF CORRECTION

PATENT NO. : 5,887,392

DATED : March 30,1999

INVENTOR(S) : Martin

It is certified that error appears in the above-identified patent and that said Letters Patent is hereby corrected as shown below:

On the title page, Item [56], after References Cited, U.S. Patent Documents, add the following:

| | | |
|---|---|---|
| --5,699,636 | 12/1997 | Stark |
| 5,675,937 | 10/1997 | Stebel |
| 5,671,566 | 09/1997 | Tix et al. |
| 5,575,116 | 11/1996 | Carlson et al. |
| 5,526,608 | 06/1996 | Stark |
| 5,414,962 | 05/1995 | Forbis et al. |
| 5,375,376 | 12/1994 | Scott |
| 5,265,308 | 11/1993 | May et al. |
| 5,199,219 | 04/1993 | Martini et al. |
| 4,726,148 | 02/1988 | Tix |
| 4,720,936 | 01/1988 | Ellingson |
| 4,563,381 | 01/1986 | Woodland |
| 4,470,222 | 09/1984 | Killingsworth |
| 4,307,542 | 12/1981 | Lense |
| 4,299,060 | 11/1981 | Tippmann |
| 4,266,387 | 05/1981 | Karlsson |
| 4,128,967 | 12/1978 | Kirsch |
| 4,034,514 | 07/1977 | Cecil, deceased |
| 4,034,510 | 07/1977 | Huelsekopf |
| 4,012,878 | 03/1977 | Ellingson |
| 4,004,389 | 01/1977 | DiFazio |
| 3,940,898 | 03/1976 | Kaufman |
| 3,562,954 | 02/1971 | Duguay |
| 3,374,821 | 03/1968 | White |
| 3,269,062 | 08/1966 | Mears, Jr. |
| 3,203,053 | 08/1965 | Lane et al. |
| 3,114,179 | 12/1963 | Briggs |

UNITED STATES PATENT AND TRADEMARK OFFICE

CERTIFICATE OF CORRECTION

PATENT NO. : 5,887,392

DATED : March 30,1999

INVENTOR(S) : Martin

It is certified that error appears in the above-identified patent and that said Letters Patent is hereby corrected as shown below:

| | | |
|---|---|---|
| 2,876,506 | 03/1959 | Knebel |
| 2,766,860 | 10/1956 | Travis |
| 2,719,342 | 10/1955 | Hunt |
| 2,187,459 | 01/1940 | Lorenz |
| 1,953,743 | 04/1934 | Burrell |
| 1,728,344 | 09/1929 | Hellstrand |
| 1,632,789 | 06/1927 | Domscheit |
| 1,559,502 | 10/1925 | Campbell |
| 1,113,157 | 10/1914 | Forsyth |
| 971,261 | 09/1910 | Frisbee |
| 818,703 | 04/1906 | McGinnis |
| 722,305 | 03/1903 | Hultmark--. |

After [56]References Cited, US. Patent Documents, add the following:
--OTHER PUBLICATIONS, Astro Plastics Catalog Sheet, 1992--.

Signed and Sealed this

Twentieth Day of July, 1999

*Attest:*

Q. TODD DICKINSON

*Attesting Officer*

*Acting Commissioner of Patents and Trademarks*